United States Patent [19]

Klingenberg

[11] 4,327,429

[45] Apr. 27, 1982

[54] WATCHCASE

[76] Inventor: Hans U. Klingenberg, 3274 St. Niklaus bei Merzligen, Canton of Berne, Switzerland

[21] Appl. No.: 120,324

[22] Filed: Feb. 11, 1980

Related U.S. Application Data

[63] Continuation of Ser. No. 921,607, Jul. 3, 1978, abandoned.

[30] Foreign Application Priority Data

Jul. 15, 1977 [CH] Switzerland ..... 8813/77

[51] Int. Cl.[3] ..... G04B 37/00

[52] U.S. Cl. ..... 368/294

[58] Field of Search ..... 368/88, 276, 280, 285, 368/294–296, 309

[56] References Cited

U.S. PATENT DOCUMENTS

D. 242,436 7/1975 Nilson ..... D10/30

3,690,062 9/1972 Kasai et al. ..... 58/88 R 3,977,176 8/1976 Murakami et al. ..... 58/23 BA 4,003,196 1/1977 O'Conner ..... 58/4 A

*Primary Examiner*—Vit W. Miska

*Attorney, Agent, or Firm*—Stevens, Davis, Miller & Mosher

[57] ABSTRACT

In a watchcase body comprising a caseband and a glass, provision is made for fitting a wrist watch movement by means of metal rings. The caseband is of hard material, e.g., synthetic stone or sintered alumina, while the glass is of transparent mineral material, sapphire or mineral glass. The caseband and glass are permanently and rigidly joined without any intervening metal parts. The underside of the glass is metallized along the periphery, then cemented to the annular top surface of the caseband. After cementing, the watchcase body is finished by machining one or more continuous facets on the outer rim of the glass and the outer surface of the caseband.

5 Claims, 3 Drawing Figures

WATCHCASE

Figure 1:
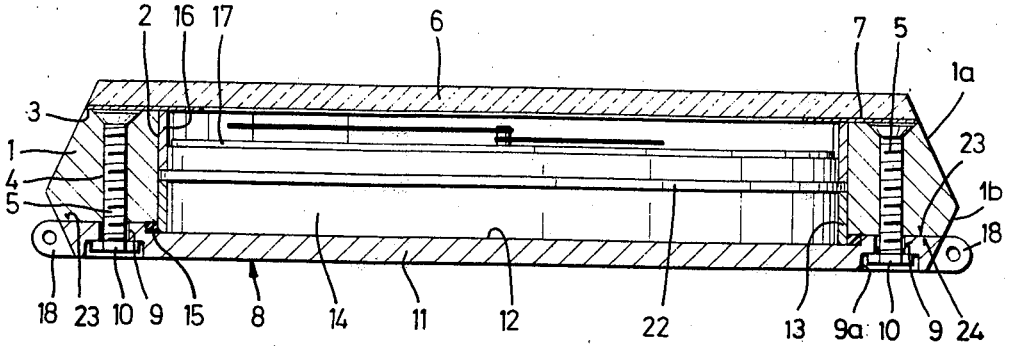

This is a continuation of application Ser. No. 921,607 filed July 3, 1978, abandoned.

This invention relates to watchcases, and more particularly to a watchcase of the type comprising a case-body composed of a caseband and a glass, both of hard material.

The use of non-deteriorating materials for various parts of watchcases; especially scratchproof hard materials, is known to entail numerous manufacturing problems. As there is an ever-increasing need for watchcases of this type in the watchmaking industry, particularly for wrist watches, several attempts have been made in recent years to facilitate the production of watchcases made of such materials.

However, since very hard materials are not easy to machine, there are difficulties in assembling the various parts of the case, above all if the appearance of the watchcase as a whole is to be as attractive as possible, which is usually a requirement.

In order to overcome these difficulties, my U.S. Pat. No. 3,307,346 proposes that a one-piece combined caseband and back be assembled with a glass of mineral material by means of metal claws fixed to the frustoconical top surface of the case-body. Because this design requires the machining of delicate metal parts, the cost is relatively high. Moreover, this design lends itself only to round watches if fluid-tight fixation of the glass is to be ensured.

As disclosed in my U.S. Pat. No. 3,719,038, another solution to the problem consists in producing the glass and the caseband of a watchcase in one piece and fixing a metal back thereto.

However, because it is desirable for esthetic reasons to make the caseband opaque in order to hide the sides of the movement and the means for securing it, a slightly translucent material must be used, and the central portion of the case-body serving as the glass must be made thin enough so that the display members are visible through it. This design entails certain risks in that the thickness of the central "screen" portion must be reduced to such an extent that its strength is jeopardized. If it is sought to make it thick enough to ensure its sturdiness, it becomes difficult to tell the time through this thin translucent element.

The attempt has likewise been made to secure a transparent glass, e.g., a sapphire glass, permanently to a case-body of hard mineral or metallic material such as a metal carbide. For this purpose, U.S. Pat. No. 3,911,670 proposes, for example, the use of an annular mounting of ductile steel, e.g., a nickel steel having a high nickel content. This mounting is gripped between the sapphire glass and the caseband of sintered material. The aim is to produce a rigid assembly, all the elements of which have substantially similar thermal-expansion coefficients in order to avoid the stresses which arise in the event of temperature variations. However, a drawback of this solution is that the steel mounting remains visible between the glass and the sintered part of the caseband unless complicated shapes are given to both the caseband and the glass. Yet such shapes are scarcely compatible with the hard structure of the objects in question.

It is therefore an object of this invention to provide a watchcase of the type initially mentioned which avoids the foregoing drawbacks and which is also compatible with attractive and yet reliable designs in which the means for securing the glass to the caseband do not include any visible metal element.

It is a further object of this invention to provide a watchcase utilizing recent contributions to the technology of glues and adhesives, as well as to to that of thin, adherent coatings.

To this end, there is provided according to the present invention a watchcase comprising a detachable metal back; an annular caseband of hard material having a top surface remote from the back, a bottom surface facing the back, and an outer surface; and a glass of hard material having an outer rim and a peripheral annular bottom surface cemented to the top surface of the caseband, the caseband and the glass together forming a case-body having one or more facets extending partially over the outer surface of the caseband and partially over the outer rim of the glass.

Figure 2:
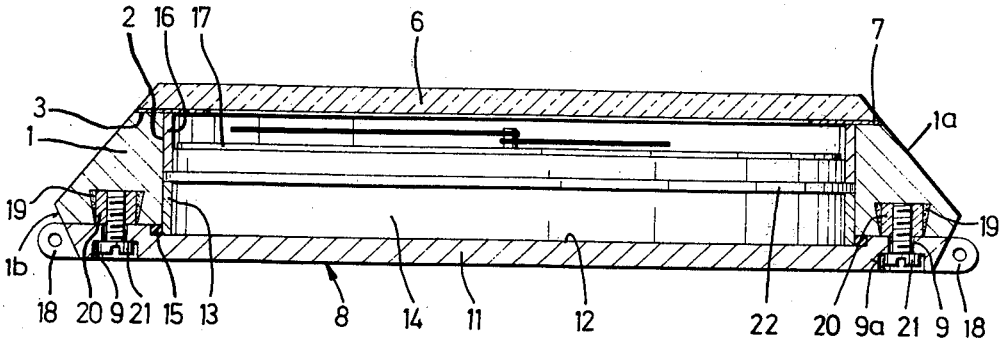
Figure 3:
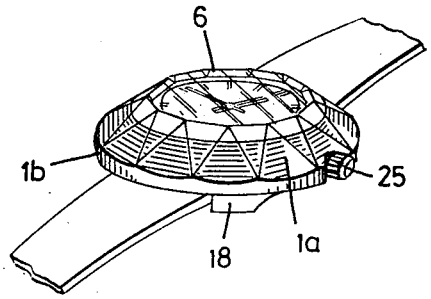

Two preferred embodiments of the invention will now be described in detail with reference to the accompanying drawing, in which:

FIG. 1 is an axial section through a watchcase in a first embodiment of the invention, FIG. 2 is a sectional view through a second embodiment, and FIG. 3 is a perspective view of the second embodiment.

The main part of the case shown in FIG. 1 is a caseband 1; this is a hard solid part which may be made of various materials, e.g., corundum, lapis lazuli, onyx, a preferably sintered synthetic material such as a cermet, or sintered hard metal. The caseband 1 may also be of molded material such as plastic or, if need be, of metal, especially a high-hardness alloy. As may be seen in FIG. 1, the caseband 1 has an inner surface 2, the generatrices of which are straight and vertical. If the case is round, the inner surface 2 will be circular-cylindrical. However, the caseband 1 may equally well be rectangular or square. The top surface 3 of the caseband 1 is plane, but it may also be slightly conical in order to better the centering of a glass 6. The top surface 3 comes in contact with the glass 6 and is secured thereto by adhesion, as will be explained below. Furthermore, the caseband 1 has a bottom surface 23, likewise plane, against which there rests a corresponding annular surface 24 of a back 8. Finally, the caseband 1 exhibits an outer side surface, the upper portion of which takes the form of plane facets 1*a* distributed along a frustoconical inclination, and the lower portion of which is a frustoconical surface 1*b* which may, as a variation, equally well be a circular-cylindrical surface coaxial with the watchcase as a whole.

In the embodiment illustrated in FIG. 1, two holes 4 pass through the caseband 1 for receiving screws 5, the heads of which are sunk in flared upper end portions of the holes 4 and immobilized there by cementing. Provision might also be made for three or four holes 4 and a like number of screws 5. The caseband 1 will also include a radial bore through which a control stem may pass. This control stem bears a crown 25 (FIG. 3), and the caseband 1 may be equipped with a metal tube coaxial with the stem and coöperating with a gasket fitted on the crown 25, as in conventional water-resistant watches.

The glass 6, which completes the case-body shown in FIG. 1, is of sapphire and is either flat top and bottom or made so that the peripheral zone on its underside matches the top surface 3 of the caseband 1. In either case, the peripheral zone on the underside of the glass 6 bears an extremely thin coating 7 of metal, e.g., gold, deposited by the process of chemical vaporization. By this process, well known to those skilled in the art, a thin coating of particularly strong adherence can be deposited on a smooth surface of a part such as the glass 6. The coating will be just thick enough to make the annular peripheral zone of the glass 6 opaque. As a modification, this opaque peripheral zone might be produced by incorporating metallic or other particles in the glass. If the coating 7 is used, it is essential that it be particularly adherent since it forms the intermediary for fixing the glass 6 to the caseband 1. As may be seen from the drawing, the metal coating 7 of the glass 6 covers the plane surface 3 of the caseband 1, and these two surfaces are bonded to one another by cementing. Because of the coating 7, both the heads of the screws 5 and the cement are invisible. As a further modification, it would be possible to use an opaque cement, either with or without the coating 7.

In order to render the resultant case-body more attractive, the side surfaces of the glass 6 and the caseband 1 are machined together after cementing of the glass by grinding the facets 1*a* extending over both the rim of the glass 6 and the outer surface of the caseband 1. Thus a perfect join is obtained between the two parts, and the interface is invisible. Moreover, since the screws 5 are cemented to the caseband 1, the composite assembly formed by the caseband 1 and the glass 6 is like a single piece, to which the back 8 may easily be attached.

The back 8 comprises a preferably metal plate 11, with a shallow recess 12 machined in its inside surface, and an annular wall 13 of brass or some other metal, which will be adapted to the dimensions of a movement 14 intended to be fitted in the case. The wall 13 constitutes a support ring for the movement 14; it may be soldered or cemented by its lower edge to the bottom of the recess 12, leaving at its periphery a space in the form of an annular groove for holding a gasket 15. When the wall 13 is soldered or cemented to the back 8, it ensures the rigidity of the latter, so that the thickness of the portion of the plate 11 beneath the recess 12 may be reduced to a minimum.

As may be seen in FIG. 1, the plate 11 includes amply dimensioned apertures 9 for receiving the ends of the screws 5 and allowing for expansion of the back 8. The back 8 may be fixed by means of nuts 10 which, after being affixed to the screws 5, are sunk within the entry recesses 9*a* of the apertures 9.

The plate-bead 22 of the movement 14 supports the latter on the upper rim of the wall 13. The movement 14 may be cased within the back 8, then fitted in the case-body 1,6. For completing the fixing operation, it is preferable to use a casing-ring 16 which will also be adapted to the dimensions of the inner surface 2 of the caseband 1 and which will extend in height from the plate-bead 22 to the level of the underside of the glass 6. The casing-ring 16 will rest beneath and against the opaque coating 7, which will be made wide enough to extend over part of the interior of the caseband 1, thus hiding both the casing-ring 16 and the periphery of a dial 17. The height of the casing-ring 16 will naturally be such that sufficient hand-fitting space is left between the dial 17 and the underside of the glass 6.

The flat plate 11 constituting the main part of the back 8 will comprise means for attaching a watchband, e.g., horns 18. In a case having a round caseband 1, the plate 11 might be either round or square.

Other transparent materials might equally well be used for the glass 6 instead of sapphire or mineral glass, heat-treated or not. In any event, the materials chosen for the glass 6 and the caseband 1 should have hardnesses as similar as possible so that the coefficients of expansion are likewise similar. The glass 6 will be of transparent material and the caseband 1 of opaque material. If so desired, the material of the glass 6 might be slightly tinted in the same shade as the caseband 1, with the glass 6 being sufficiently transparent so that the hands beneath it may be clearly seen. If the caseband 1 is of ceramic or plastic material, the material chosen for the glass 6 should likewise meet the conditions of hardness and coefficient of thermal expansion mentioned above.

The embodiment illustrated in FIG. 2 is similar to that of FIG. 1 in that it also comprises a glass 6 having an opaque peripheral zone 7 formed on the underside by vacuum-vaporization of a metal deposit, and a caseband 1 having an inner surface 2 without notches or undercuts. The inner surface 2 might also be metallized. A back 8 is also constituted in the same way as in the first embodiment.

However, the caseband 1 does not include holes 4 passing completely through it, but rather cavities 19 produced by ultrasonic machining by grinding, or by electroerosion. The cavities 19 have flat bottoms and slightly frustoconical, inwardly flaring sidewalls. They open out at their smaller end into the likewise plane bottom surface of the caseband 1 and accommodate tapped bushings 20 for receiving screws 21 which are inserted through apertures 9 in the back 8 and then tightened from the back. The heads of the screws 21 are sunk in the entry recesses 9*a* of the apertures 9.

In this embodiment as well, the back 8 is made up of a plate 11 and a wall or support-ring 13. These two parts may be independent of one another, and the groove for receiving the gasket 15 may be made in the annular surface surrounding the recess 12. The movement 14 is likewise secured within the back 8 by a casing-ring 16, the inner surface of which extends to the top of the hand-fitting space.

If the choice of materials allows, or if it is desired to make the caseband 1 as rigid as possible by limiting its outside dimensions, shoulders may be formed in the inner surface of the caseband 1 for guiding the movement 14 or for supporting the edge of the dial 17.

The design described lends itself not only to conventional round watchcases but also to thin watchcases which are rectangular, square, or of other shapes.

The horns 18 form part of the back 8 and are provided with holes for inserting the ends of the attachment bars of the watchband. The watchband may also be combined with the back in one piece, in which case it forms the continuation of the latter.

It will also be noted that the caseband 1, instead of being of opaque material, might equally well be made of a transparent or translucent base material and be treated by metallic or other vapor-deposit to make its inner surfaces opaque. Even if plastic materials are used to make the caseband 1, e.g., polyethylene or the thermoplastic synthetic resin sold under the trademark "Plexiglas," adherent metal coatings may be applied to the inner surfaces.

What is claimed is:

1. A watchcase comprising an annular frustoconical caseband have a top flat annular surface, a glass made of a transparent material having a flat bottom annular surface complementary to the annular surface of the caseband, said glass and said caseband being of materials of substantially the same hardness and substantially the same coefficient of thermal expansion and both having faceted side faces, said complementary flat surfaces being cemented together with said faceted surfaces in mutual registry to form an integral main member, no portion of said caseband traversing the plane of said cemented surfaces, and a bottom removably secured to said main member.

2. A watchcase in accordance with claim 1, wherein said complementary surface of said glass bears an opaque coating extending inwardly at least to the space within said annular caseband.

3. A watchcase in accordance with claim 1, further comprising an annular wall disposed within said caseband and resting on said back for supporting a watch movement.

4. A watchcase in accordance with claim 3, wherein said annular caseband has a single inner surface generated by a straight vertical line and further comprising a casing-ring and an annular wall, the inner surface of said glass being opaque in an annular region radially inward of said complementary surface, said casing-ring resting against said glass in the opaque region of said glass, said annular wall and said casing-ring lying against said inner surface of said caseband and cooperating therewith to support a watch movement.

5. A watchcase comprising an annular caseband have a top flat annular surface, a glass made of a transparent material having a flat bottom annular surface complementary to the annular surface of the caseband, said glass and said caseband being of materials of substantially the same hardness and substantially the same coefficient of thermal expansion and both have side faces, said complementary flat surfaces being cemented together to form an intergral main member, said side faces of said glass and said caseband being formed of faceted surfaces in mutual alignment, no portion of said caseband traversing the plane of said cemented surfaces, and a bottom removably secured to said main member.

* * * * *